US005816929A

United States Patent [19]

Koch et al.

[11] Patent Number: 5,816,929

[45] Date of Patent: Oct. 6, 1998

[54] GOLF SWING TRAINING DEVICE

[75] Inventors: Robert C. Koch; Alfred J. Koch, both of Strongsville, Ohio

[73] Assignee: R.M.&G Products, Inc., Brunswick, Ohio

[21] Appl. No.: 705,071

[22] Filed: Aug. 29, 1996

Related U.S. Application Data

[63] Continuation of Ser. No. 34,529, Mar. 19, 1993, abandoned, which is a continuation of Ser. No. 823,129, Jan. 21, 1992, Pat. No. 5,195,748.

[51] Int. Cl.[6] ..... A63B 69/36

[52] U.S. Cl. ..... 473/232

[58] Field of Search ..... 473/232

[56] References Cited

U.S. PATENT DOCUMENTS

| | | | |
|---|---|---|---|
| 1,529,305 | 3/1925 | Gatke | 473/232 |
| 4,854,585 | 8/1989 | Koch et al. | 473/232 |
| 4,856,782 | 8/1989 | Cannan | 273/193 B X |
| 5,195,748 | 3/1993 | Koch et al. | 473/232 |

FOREIGN PATENT DOCUMENTS

| | | | |
|---|---|---|---|
| 2103492 | 8/1981 | United Kingdom | 273/186.2 |
| 2103492 | 2/1983 | United Kingdom | 473/232 |

*Primary Examiner*—George J. Marlo

*Attorney, Agent, or Firm*—Fay, Sharpe, Beall, Fagan, Minnich & McKee

[57] ABSTRACT

A new golf swing training device has a club with an elongated shaft with a hand grip at one end and a club head at the other end. A hinge is interposed between the first and second ends to allow the club head to break both rearwardly and forwardly. A spring biased projection cooperates with a recess so that different forces are required to break the club head in one direction, i.e., rearwardly, relative to a second force required to break the club in a second direction, i.e., forwardly. The tension of the hinge may also be adjusted. Access to the adjusting member is accessible from a location adjacent and non-aligned with the longitudinal axis of the club. In one embodiment, the hinge may be defined by a male/female assembly. In another embodiment, the hinge is defined by substantially identical side-by-side members.

8 Claims, 6 Drawing Sheets

GOLF SWING TRAINING DEVICE

This is a continuation of application Ser. No. 08/034,529 filed on Mar. 19, 1993, now abandoned which is a continuation of Ser. No. 07/823,129 filed on Jan. 21, 1992 U.S. Pat. No. 5,195,748.

BACKGROUND OF THE INVENTION

This invention pertains to the art of training devices and more particularly to a golf swing training device. The invention is particularly applicable to a golf swing training device that permits a golfer to detect certain types of errors in his swing, and provides a positive indication of the error. If the golfer's swing is properly executed, the golfer is able to hit a golf ball with the training device, and again, obtain immediate and positive feedback. However, it will be appreciated that the invention has broader applications and may also be employed without actually hitting a golf ball, or in conjunction with other golf swing training methods, devices, and instruction.

A number of golf swing training devices are already known in the art, but this invention is particularly an improvement of commonly assigned U.S. Pat. No. 4,854,585 of Koch, et al. As shown and described in that patent, a two-way hinge is included in the golf club shaft to permit the club head, whether a wood or iron, to break from an aligned arrangement with the remainder of the shaft and indicate a fault or error in the golfer's swing. If a swing is technically proper, the hinge remains unbroken, the shaft portions aligned, and the golfer can strike a ball to instantly perceive the success in his swing.

U.S. Pat. No. 4,854,585, the disclosure of which is hereby incorporated by reference, teaches one preferred structure in which a hinge assembly includes a projection, a means for receiving the projection, and means for biasing the projection into the receiving means to tension or maintain the hinge in an unbroken state. More particularly, the U.S. Pat. No. 4,854,585 patent employs a ball as the projection which is biased outwardly from one hinge member by a coil spring. The ball is received in a recess on the other hinge portion to maintain the hinge and shaft portions in aligned fashion until a predetermined force imposed by a faulty swing overcomes the spring bias and permits the club head to break either rearwardly or forwardly. An adjustment member cooperates with the spring so that the tension on the ball member, and thus the hinge assembly, can be adjusted if so desired.

Golf swing training devices sold under the teachings of the U.S. Pat. No. 4,854,585 patent have met with substantial commercial success. Various potential areas for improvement, though, are addressed by the present application. A first area of improvement is directed to ease of adjustment of the tension of the hinge assembly, i.e., the force necessary to break the hinge from its aligned position. In the arrangement disclosed in U.S. Pat, No. 4,854,585, the grip must be removed from the upper portion of the shaft and an elongated tool inserted through the upper shaft portion to alter the biasing force as desired. It is deemed to be a complicated process to provide for adjustment of the training device, particularly for the end user who oftentimes does not have access to necessary equipment.

A second area of improvement is associated with the force necessary to break the hinge to indicate a faulty golf swing. That is, and due to the dynamics of a golf swing, it is deemed desirable to make it more difficult to break the hinge in one direction relative to the other direction. Thus, deflection of the club head forwardly during certain improper movements of the club will require a different magnitude of force than to break the club head rearwardly. In other words, certain errors in a golf swing are more easily detected than other errors in a golf swing.

SUMMARY OF THE INVENTION

The present invention contemplates a new and improved golf swing training device which satisfies the above-referenced goals and others in a manner that is simple, practical, and economical to manufacture and use.

According to the present invention, the subject new golf club modifies the hinge assembly to accommodate ease of access to the altering or tensioning means.

According to another aspect of the invention, the tensioning means is offset and generally parallel to the longitudinal extent of the club shaft.

According to yet another aspect of the invention, the hinge assembly incorporates means for requiring different forces to break the club rearwardly and forwardly.

According to still another aspect of the invention, the offset tensioning means facilitates lining up of the club for use.

A principal advantage of the invention resides in the ease of adjusting the tension of the hinge assembly.

Yet another advantage of the invention is realized by the lower cost, maintenance, and ease of use associated with the new invention.

Still another advantage of the invention resides in the ability to fine tune one's golf stroke by requiring different forces to break the hinge assembly for different club movement errors.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED AND ALTERNATE EMBODIMENTS

Figure 1:
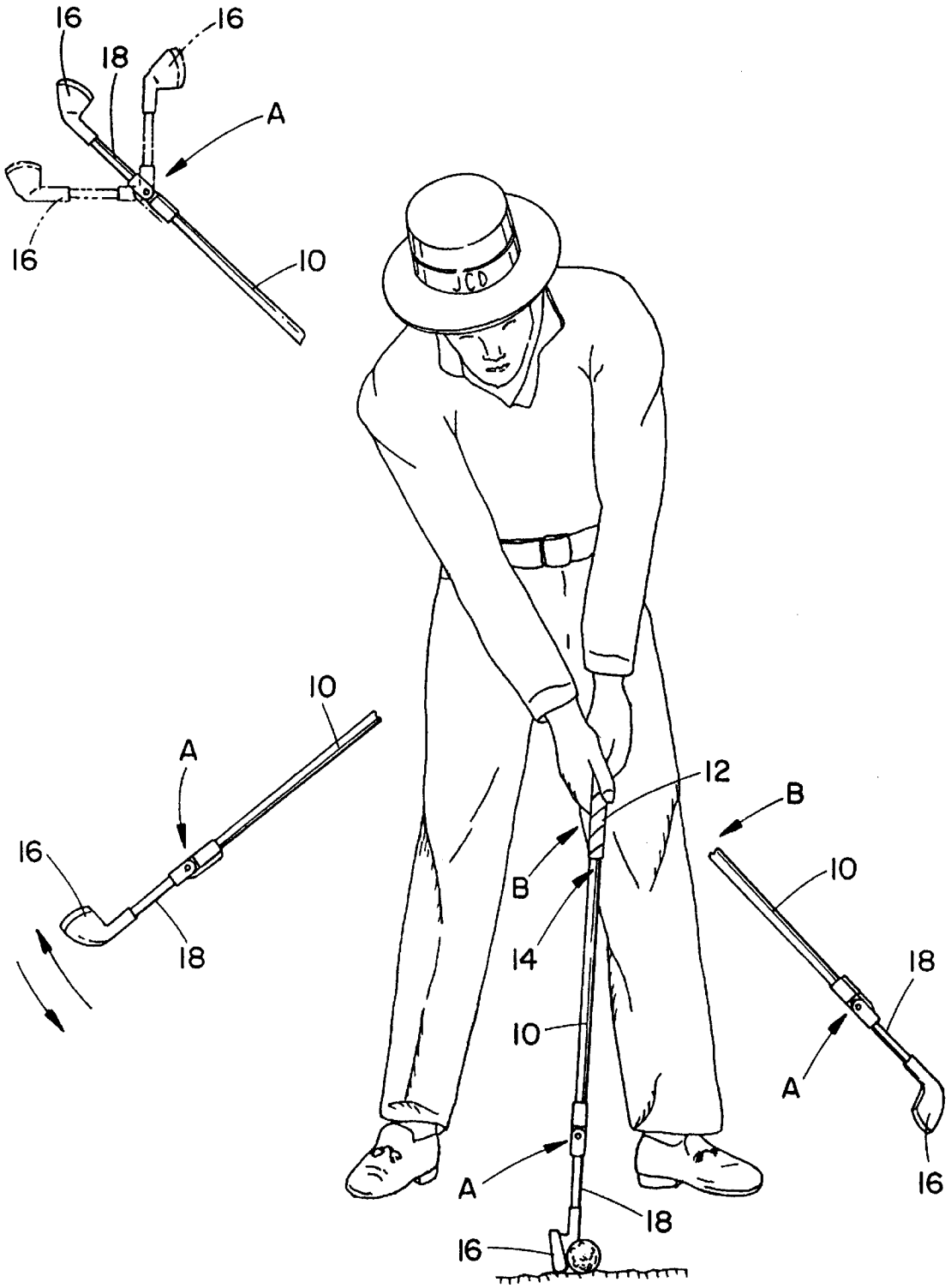
FIG. 1 illustrates the subject training device at various positions through a golf swing, with breaks in the hinge assembly illustrated in phantom.
Figure 2:
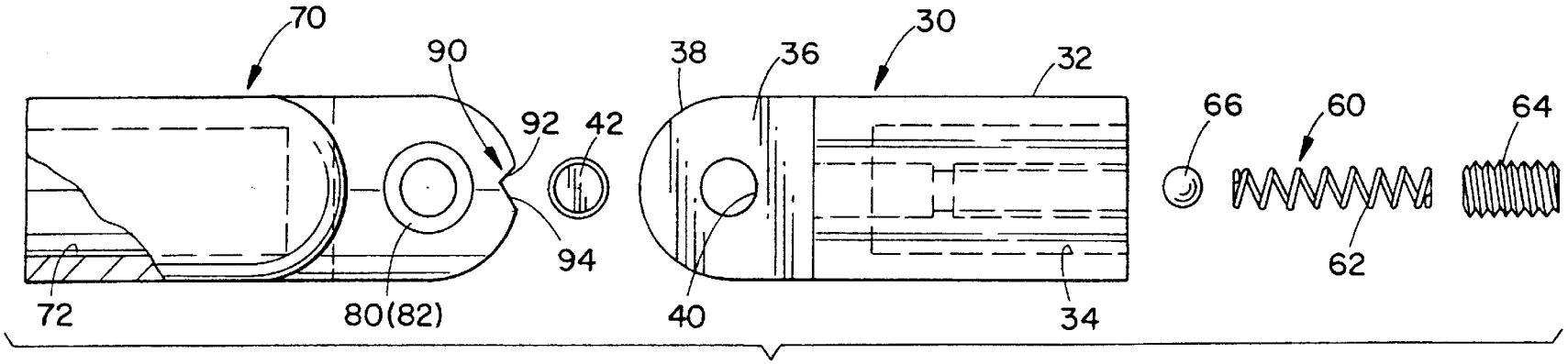
FIG. 2 is an exploded elevational view of the subject new hinge assembly particularly showing male and female portions thereof.

Referring now to the drawings wherein the showings are for purposes of illustrating the preferred embodiments of the invention only and not for purposes of limiting same, the FIGURES show a golf swing training device having a hinge assembly A incorporated in a golf club B.

More particularly, the golf club B is of standard, well known construction comprising an elongated shaft 10, a hand grip 12 at a first or upper end 14 of the shaft, and a club head 16 at a second or lower end of the shaft 18. The club head 16 is shown as an iron, although it will be readily understood that the club head could also be a driver, or of metal or wood construction.

The hinge assembly A is a two-part construction defined by cooperating male and female members in a first preferred arrangement. As will be further described below, still other hinge assemblies are contemplated and may be used within the scope and intent of the subject invention. It is preferred, though, that the hinge assembly permit two-way movement of the lower end of the shaft, i.e., the club head, in both rearward and forward directions relative to the upper end of the shaft. These movements are particularly shown in phantom in the upper, left-hand portion of FIG. 1.

With continued reference to FIG. 1, and additional reference to FIGS. 2–6, a first preferred arrangement of the improved hinge assembly will be described in greater detail. According to that embodiment, the hinge assembly A comprises a first portion or male member 30 having a generally hollow cylindrical portion 32 at one end adapted for cooperating receipt over one of the first or second ends of the shaft. In the particular arrangement shown, the cylindrical portion cooperates with the upper end of the shaft 14. A first recess 34 is dimensioned for close receipt over the upper end of the shaft so that the shaft and male hinge member may be secured together by means of a suitable adhesive, fastener, or combination of both.

Figure 3:
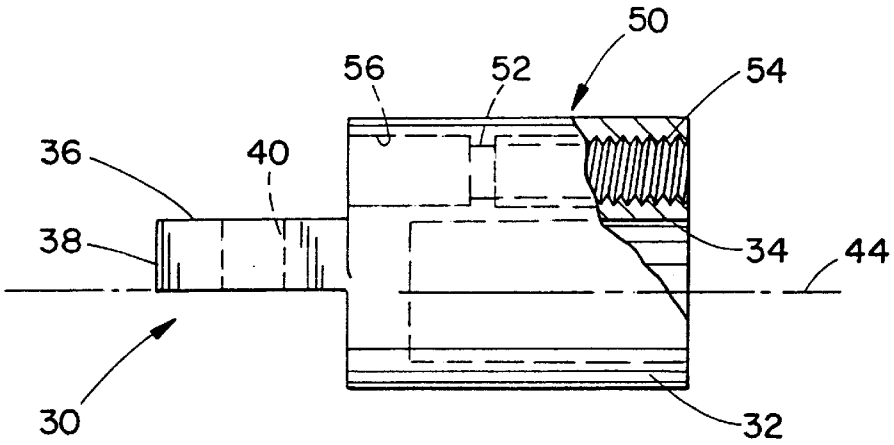
FIG. 3 is an overhead plan view of the male portion (right-hand member) of the hinge assembly of FIG. 2.

A second end of the male hinge member includes an extension 36 which will be readily understood as being received in the recess of a cooperating female portion of the hinge assembly. The extension has a smoothly rounded contour 38 (FIG. 2) and a transversely extending opening 40 adapted to receive a pivot pin 42. The pivot pin is oriented generally parallel to the face of the club head 16 whereby the hinge assembly can break rearwardly or forwardly as shown in FIG. 1. Further, the rounded contour 38 permits two-way movement or breaking of the hinge about the pivot pin. That is, the contour permits the club head to break rearwardly and forwardly relative to the upper end of the shaft and evidence a faulty swing. Preferably, the extension is slightly offset to one side of the longitudinal axis 44 of the golf club shaft (FIG. 3). Of course, other arrangements can be used, but this central positioning of the extension permits generally equally sized yoke portions of the female hinge member to be disposed on either side of the extension and as will become more apparent below.

Figure 4:
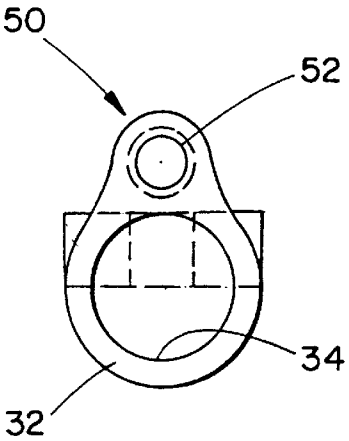
FIG. 4 is an elevational view of the male hinge portion generally taken from the right-hand end of FIG. 3.

An adjustment means 50 is integrally formed in the male member of the hinge assembly. According to the preferred arrangement, it is laterally offset from the longitudinal axis of the club shaft (FIGS. 3 and 4). The adjustment means 50 is defined by a throughbore 52 that is threaded at one end 54 and interconnects with a counterbore 56 at the other end. A biasing means 60, defined in this preferred embodiment by a coil spring 62 (FIG. 2), is received in the counterbore and urged outwardly (leftwardly) thereof by a threaded member 64 received in the threaded end 54. The opposite end of the coil spring engages a projection member defined by generally spherical ball member 66 that is thus urged outwardly into cooperative engagement with the female hinge member as will be described further below. Of course, still other types of springs and/or biasing means can be used with equal success and without departing from the scope and intent of the subject invention.

Selected adjustment of the biasing force on the ball member may be achieved by advancing or retracting the threaded member toward and away from the coil spring 62. The lateral offset of the adjustment means relative to the longitudinal axis of the club shaft provides ease of access for any golf club user. This arrangement provides ease of adjustment versus prior arrangements wherein an elongated tool was inserted through the upper end of the shaft after removal of the hand grip to effect adjustment. By means of the subject new arrangement, an adjusting tool, for example, an Allen wrench (not shown), may be supplied with the golf swing training device to permit a user to easily access the threaded member 64 through recess 52 and make any desired adjustment. Still other means for adjusting the tension of the hinge assembly and different structural arrangements are contemplated.

Still another feature provided by the adjustment means 50 is as an aid to lining up the golf club. Specifically, and as described above, the adjustment means is laterally offset to one side of the longitudinal axis of the shaft. For both aesthetic and functional reasons, placement of the adjustment means at an area generally diametrically opposite from the club head is deemed most useful. The club head extends radially or transversely from the longitudinal axis 44 of the shaft in one direction (downwardly in FIGS. 3 and 4) while the adjustment means extends transversely in the opposite direction (upwardly in FIGS. 3 and 4). When properly positioned for use in a golfer's hands, and as shown in FIG. 1, the golfer's line of sight down the club shaft 10 should have the toe or club head facing away from his body and the adjustment means essentially pointing toward him and hidden from view. Thus, if the adjustment means can be seen by the golfer when addressing the ball, rotation or positioning of the club shaft should be altered to properly position the club for use.

A second portion or female member 70 of the hinge assembly includes a recess 72 at one end diametrically dimensioned for close receipt over the club shaft. In this particular arrangement, the lower end 18 of the shaft and female hinge member are secured together. Again, any suitable securing means such as an adhesive, fastener such as a rivet or screw, or both, may be used to secure together the female hinge member and the shaft lower end. First and second yokes or flanges 74, 76 (FIGS. 5 and 6) extend axially from the second end of the female member. The yokes define a receiving means or cavity 78 therebetween to accommodate the extension 36 of the male hinge member.

Each of the yokes includes a transverse passage or opening 80, 82, respectively, that also include a countersink portion 84, 86, respectively, at the outer extremities. The transverse openings are aligned so that upon insertion of the extension of the male hinge member into the cavity 78, the openings 40, 80, and 82 are substantially aligned for receipt of the pivot pin 42 therethrough. Opposite ends of the pivot pin may be deformed or machined into the countersink portions 84, 86 to maintain the hinge members together for selective swinging relation.

Figure 5:
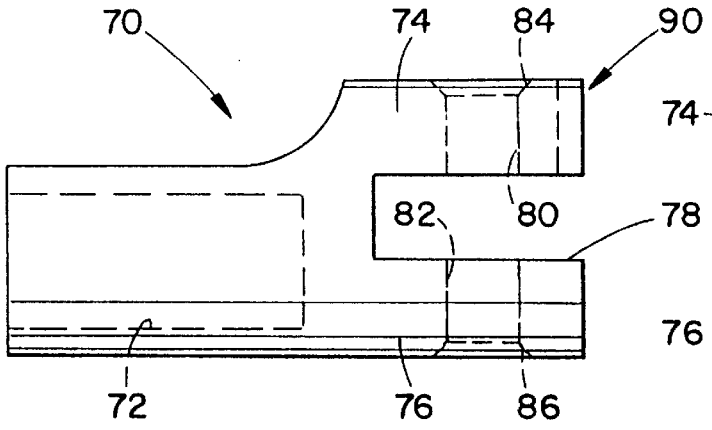
FIG. 5 is an overhead plan view of the female hinge portion (left-hand member) of the hinge assembly of FIG. 2.
Figure 6:
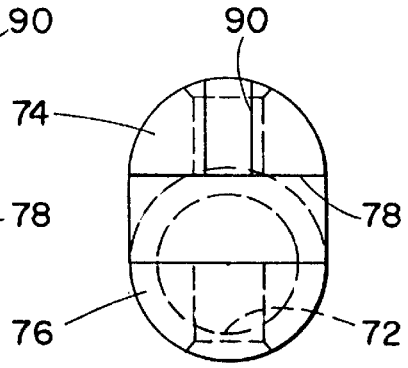
FIG. 6 is an elevational view of the female hinge portion generally taken from the right-hand end of FIG. 5.

When assembled, one of the yokes 74 is positioned axially opposite the throughbore 52 of the adjustment means in the male hinge member (FIGS. 5 and 6). That yoke includes a recess 90 formed in its otherwise smooth rounded contour. The recess is adapted to receive the ball member 66. As shown, the recess is defined generally by a V-shaped notch 90 that includes first and second angled surfaces 92, 94. The first angled surface 92 is adapted to control, along with the ball member 66, coil spring 62, and threaded member 64, the force necessary to break the club head in a forward direction. Again, and with reference to FIG. 1, this forward break is depicted in phantom and as shown by the broken line view in the upper left-hand corner at the 9 o'clock position. The second angled surface 94, on the other hand, is designed to control the force necessary to break the hinge rearwardly, i.e., at the broken line representation shown at the 12 o'clock position of FIG. 1. By controlling the angular orientation of these surfaces 92, 94 relative to the longitudinal axis, different forces will be required to break the hinge forwardly than are required to break the hinge rearwardly.

Figure 7:
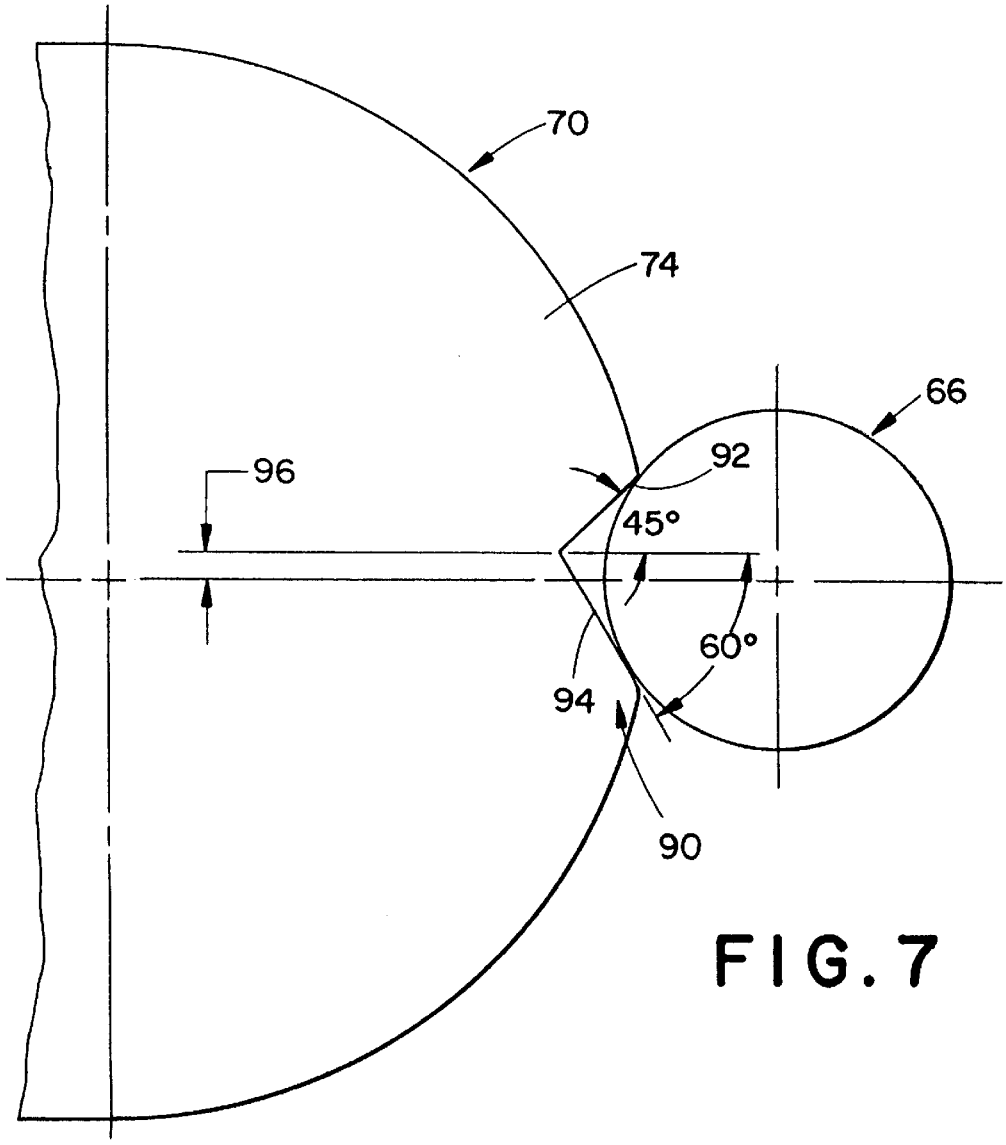
FIG. 7 is an enlarged view of a portion of the female hinge portion particularly illustrating means for requiring different forces to break the hinge assembly forwardly and rearwardly.

More specifically, and with additional reference to FIG. 7, a more acute angle, for example, in the range of 45° relative to the longitudinal axis 44, will require greater force to break the hinge than a more obtuse angle, such as a 60° angle. Further, the intersection of the angled surfaces is laterally offset in the range of 0.01 inch from the longitudinal axis and as represented by numeral 96. As will be understood by one skilled in the art, still other angles and dimensional relationships may be used without departing from the scope and intent of the subject invention.

Figure 8B:
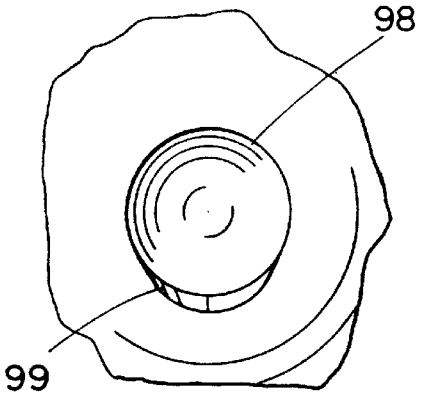
FIG. 8*b* is an end view taken generally from the right-hand side of FIG. 8*a* with the ball member removed for ease of illustration.
Figure 8A:
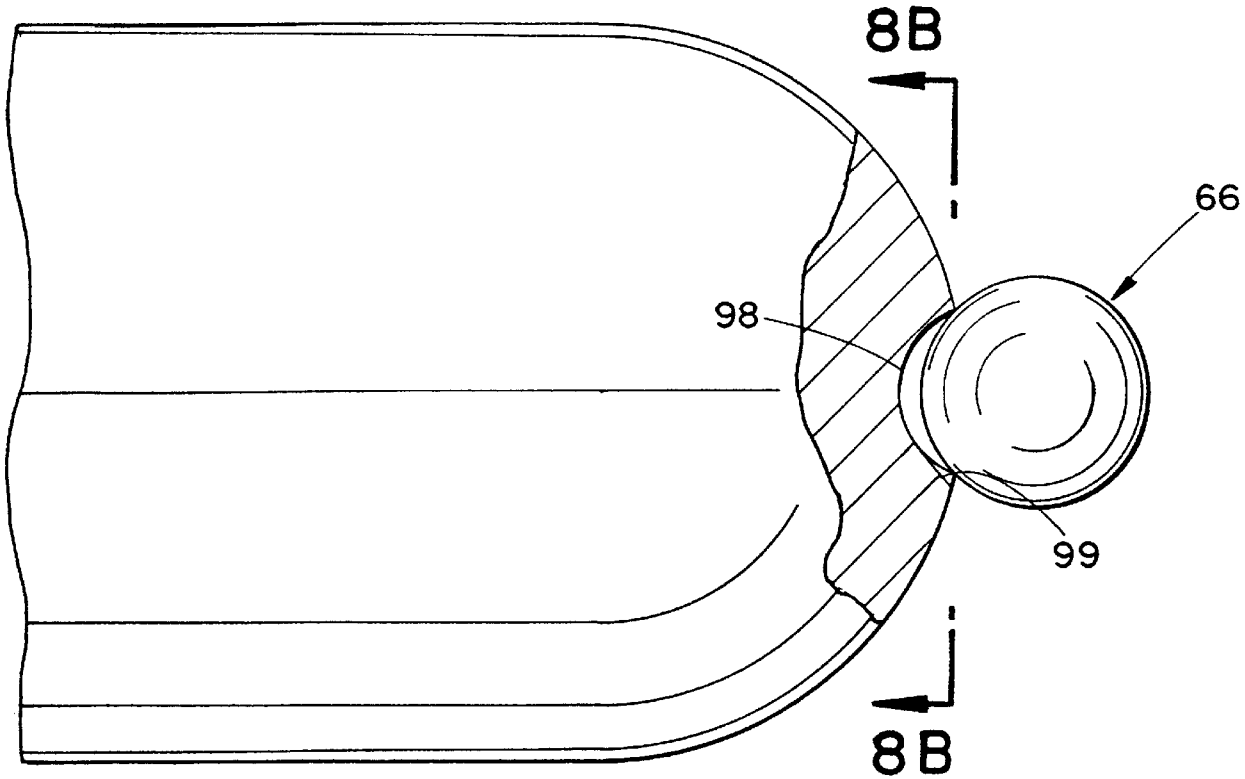
FIG. 8*a* is an enlarged view similar to FIG. 7 and showing another preferred arrangement of the female hinge portion.

FIG. 8*a* illustrates another preferred arrangement for the recess 90. As shown, a generally hemispherical recess 98 is formed in the yoke 74. According to the principles of this embodiment, the curvature of the recess 98 is substantially less than that of the ball member 66. By way of example only, one preferred arrangement has a ball member diameter in the range of 5/32 of an inch while the recess is based on a diameter on the order of magnitude of 1/8 or 7/64 of an inch. A chamfer or bevel 99 is formed along one edge of the recess, and as more particularly shown in FIG. 8*b*, extends circumferentially through an included angle of approximately 60°. The chamfer allows the hinge to break more easily in one direction, i.e., over the chamfer, than in the other direction for the same reasons as described above with reference to the V-shaped notch of FIG. 7. Again, and as will be understood by one skilled in the art, still other dimensional relationships may be used to achieve the same purpose.

Because of the positioning of the hinge assembly at the centroid of the club, faults in a golfer's swing are magnified through the length of the shaft. Further, selected errors in a golfer's swing are not as critical as others and thus need not be evidenced by a break in the hinge unless the error imposes an undue force on the hinge assembly. By controlling the angular orientation of these surfaces 92, 94 or the chamfer 99 relative to the longitudinal axis, selective control and correction of errors can be achieved. An alternative or modified hinge assembly is shown in FIGS. 9–13. Although generally speaking the principles of operation are the same, the modified hinge assembly does illustrate that different hinge configurations can be used in accordance with the teachings of the subject invention. More particularly, a pair of substantially identical hinge halves 100, 102 are utilized rather than the male and female hinge members of the prior embodiment. A first hinge half 100 shown in FIGS. 9–11 has a generally hollow cylindrical first end 104 that includes a bore 106 extending therethrough. In this arrangement, the outer diametrical dimension of the first end is selectively received within the hollow club shaft, as opposed to the prior embodiment where the shaft is received within the hinge assembly. Again, any suitable securing means such as an adhesive, fastener, or combination of both can be used to secure the hinge half 100 to the upper end of the shaft 14. The throughbore 106 is threaded at one end 108 to receive an exteriorly threaded member 110 therein. Further, a coil spring 112 defines the biasing means that has one end that cooperates with the threaded member and a second end operatively associated with the projecting ball member 114. A single extending flange or yoke 116 is laterally offset from the longitudinal axis of the hinge half. The flange includes a lateral or transversely extending opening 118 that receives a pivot pin 124. One end of the opening is countersunk 126 so that the pin may be deformed or diametrically enlarged to prevent inadvertent removal and separation of the hinge assembly.

Figure 9:
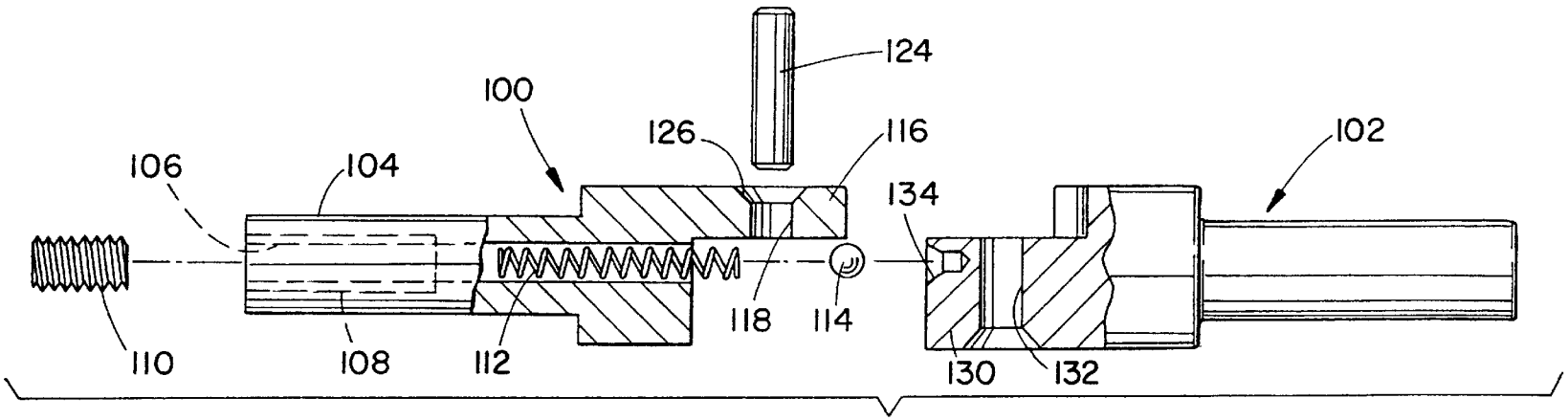
FIG. 9 is an exploded plan view of a modified hinge assembly.
Figure 11:
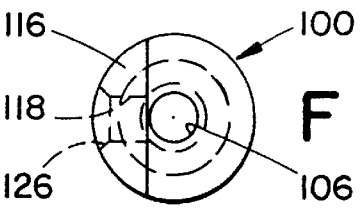
FIG. 11 is an end view of the hinge portion of FIG. 10.
Figure 10:
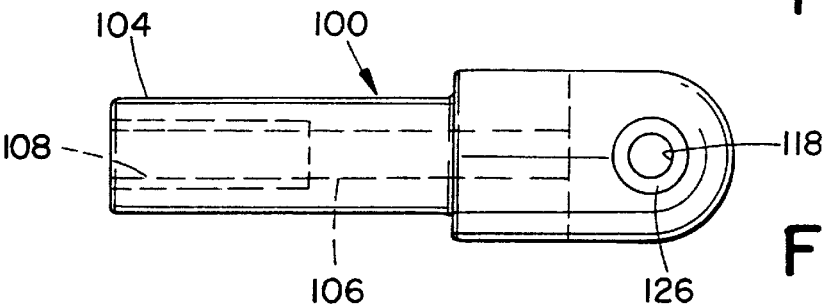
FIG. 10 is an elevational view of the left-hand half of the hinge assembly of FIG. 9.
Figure 12:
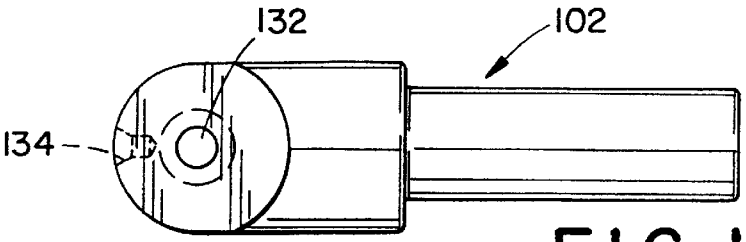
FIG. 12 is an elevational view of the right-hand hinge portion of FIG. 9.
Figure 13:
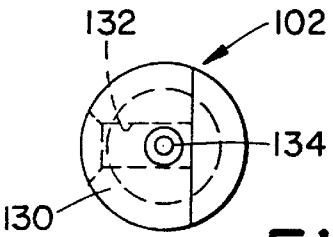
FIG. 13 is an end view of the hinge half of FIG. 12.

As shown in FIGS. 9, 12, and 13, the second hinge half 102 is of substantially identical construction. It does not, though, incorporate a throughbore. Its first end is likewise diametrically dimensioned for receipt within the hollow lower end of the club shaft. Further, it is suitably secured by means of an adhesive, rivet, or other equivalent arrangement to the club shaft. The second hinge half also includes an axially extending flange 130 which is of slightly larger lateral dimension than the flange 116 in the first hinge half. Particularly, a portion of the flange extends along the longitudinal axis of the shaft when assembled in the golf club for reasons which will become more apparent below. The flange also includes a transverse opening 132 that, when aligned with opening 118 of the first hinge half, cooperatively receives the pivot pin to interconnect and permit selective swinging movement between the hinge halves. Each of the flanges 116, 130 have smoothly rounded contours (FIGS. 10 and 12) that permit two-way movement of the hinge, i.e., both rearwardly and forwardly, as shown in FIG. 1.

Defined in the end of flange 130 is a receiving means or recess 134 that cooperatively receives the ball member 114 from the first hinge half. As shown, this recess has a generally hemispherical contour to accommodate the spherical contour of the ball member. By selective adjustment of the threaded member 110, the force imposed by the coil spring on the ball member, and thus the contact force between the ball member and recess 134, may be selectively adjusted.

Although this arrangement does offer the advantages of having substantially identical hinge half arrangements, adjustment must necessarily be made through the club shaft. Likewise, although the recess 134 has a hemispherical contour, it will be understood that other contours can be used or adaptations made to this contour to vary the force necessary to break the hinge in one direction relative to the other.

Figure 14:
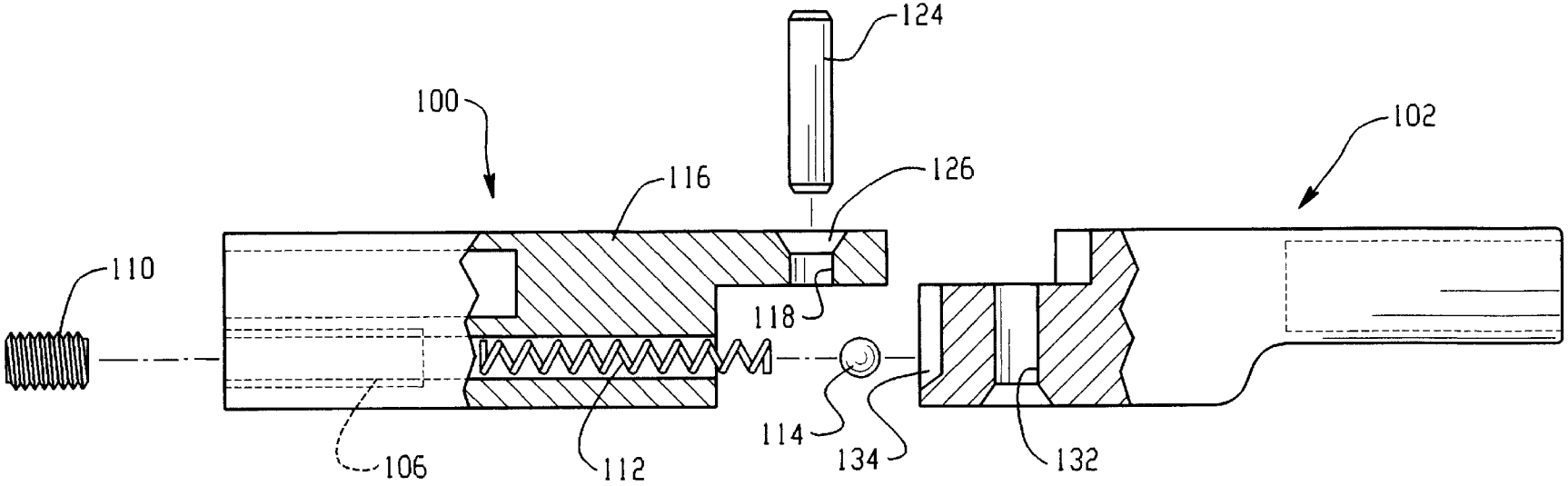
FIG. 14 is an exploded view of yet another modified hinge assembly.

Still further, and as will be understood by one skilled in the art, the first hinge half could be suitably modified to enlarge the flange 116 and laterally offset the bore 106 so that it extended therethrough as shown in FIG. 14. Like numerals refer to like elements for ease of reference. Rather than being received within the hollow club shaft, such an arrangement would necessarily encompass or surround the club shaft as in the embodiment of FIGS. 2–6. Such a modification would provide ease of access to the adjustment means without any loss in function. Of course, the second hinge half would also have to be suitably modified so that the recess 134 would be offset from the longitudinal axis. This could be easily arranged, though, in a manner similar to the embodiment of FIGS. 2–6 so that all of the benefits and advantages of the prior described embodiments could be incorporated into a hinge assembly that need not utilize cooperating male and female members.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A golf swing training device comprising:

an elongated shaft having a longitudinal axis with a club head at a first end and a handle at a second end;

a hinge incorporated into the shaft between the club head and handle and dividing the shaft into first and second shaft portions, and allowing selective two-way breaking of the shaft portions relative to one another in response to a predetermined force, the hinge being defined by first and second hinge portions disposed in side-by-side relationship, each hinge portion having only a single flange extending axially outwardly therefrom and each flange including an opening extending in a transverse direction to the longitudinal axis;

a pin received through the openings of the flanges;

a biasing member for exerting a force on the hinge and maintaining the shaft in aligned relationship along a longitudinal axis until a predetermined hinge breaking force is exceeded; and an adjustment assembly for varying the force exerted by the biasing member to vary the sensitivity of the training device to faults in a golfer's swing.

2. The golf swing training device as defined in claim 1 wherein the adjustment assembly includes a projecting member extending from one of the hinge portions and a recess in the other of the hinge portions selectively receiving the projecting member therein.

3. The golf swing training device as defined in claim 2 wherein the protecting member is a ball member.

4. The golf swing training device as defined in claim 1 wherein the adjustment assembly is accessible from a location adjacent and non-aligned with the longitudinal axis of the shaft.

5. The golf swing training device as defined in claim 4 wherein the adjustment assembly is offset from and generally parallel to the longitudinal axis of the shaft.

6. The golf swing training device as defined in claim 1 wherein the adjusting assembly is located diametrically opposite the orientation of the club head so that the adjusting assembly facilitates proper alignment of the training device.

7. The golf swing training device as defined in claim 1 wherein the biasing member includes a spring in one hinge portion that urges a projecting member toward a recess in the other hinge portion.

8. The golf swing training device as defined in claim 7 wherein the projecting member is a ball member.

* * * * *